US010283251B2

(12) United States Patent
Kanai et al.

(10) Patent No.: US 10,283,251 B2
(45) Date of Patent: May 7, 2019

(54) CHOKE COIL FOR BRAKE CONTROL DEVICE

(71) Applicants: NISSIN KOGYO CO., LTD., Nagano (JP); UENO CO., LTD., Yamagata (JP)

(72) Inventors: Sotaro Kanai, Nagano (JP); Motoyasu Nakamura, Nagano (JP); Sekihei Simozono, Nagano (JP); Tetsuo Kobori, Nagano (JP); Ryuichi Ueno, Yamagata (JP); Yukio Sato, Yamagata (JP)

(73) Assignees: UENO CO., LTD., Yamagata (JP); AUTOLIV NISSIN BRAKE SYSTEMS JAPAN CO., LTD., Ueda-Shi, Nagano (JP)

( * ) Notice: Subject to any disclaimer, the term of this patent is extended or adjusted under 35 U.S.C. 154(b) by 269 days.

(21) Appl. No.: 15/083,361

(22) Filed: Mar. 29, 2016

(65) Prior Publication Data

US 2016/0293312 A1 Oct. 6, 2016

(30) Foreign Application Priority Data

Mar. 31, 2015 (JP) ..... 2015-071160

(51) Int. Cl.
*H01F 17/06* (2006.01)
*H01F 30/16* (2006.01)
(Continued)

(52) U.S. Cl.
CPC ..... *H01F 17/062* (2013.01); *H01F 27/2828* (2013.01); *H01F 27/324* (2013.01); *H01F 2017/0093* (2013.01)

(58) Field of Classification Search
CPC ..... H01F 17/06; H01F 17/062
See application file for complete search history.

(56) References Cited

U.S. PATENT DOCUMENTS 5,789,712 A * 8/1998 Barry ..... H01F 27/027 174/138 G
6,081,180 A * 6/2000 Fernandez ..... H01F 17/062 336/229
(Continued)

FOREIGN PATENT DOCUMENTS

JP H02113311 A * 4/1990 ..... F16K 31/66
JP H02-113311 U1 9/1990
(Continued)

OTHER PUBLICATIONS

JP2507763Y2, Machine Translation, Aug. 1996.*
(Continued)

*Primary Examiner* — Elvin G Enad
*Assistant Examiner* — Malcolm Barnes
(74) *Attorney, Agent, or Firm* — Squire Patton Boggs (US) LLP

(57) ABSTRACT

A choke coil for a brake control device, includes: lead wires; a magnetic core; and a case housing the core. The case includes: a cylindrical core part around which the lead wires are wound; and a base part provided on an outer peripheral surface of the core part. End portions of the lead wires extend laterally from the core part, and holding portions configured to hold the end portions of the lead wires are formed on an outer surface of the base part on the opposite side to the core part side.

2 Claims, 4 Drawing Sheets

(51) Int. Cl.
*H01F 27/28* (2006.01)
*H01F 27/32* (2006.01)
*H01F 17/00* (2006.01)

(56) References Cited

U.S. PATENT DOCUMENTS 6,151,228 A * 11/2000 Miyazaki ..... H02J 3/01 363/37
6,262,651 B1 * 7/2001 Miyamoto ..... H01F 17/062 336/192
6,753,749 B1 * 6/2004 Chin ..... H01F 27/027 336/83
2002/0017976 A1 * 2/2002 Okamoto ..... H01F 17/04 336/229
2002/0080001 A1 * 6/2002 Kobayashi ..... H01F 17/062 336/229
2004/0233015 A1 * 11/2004 Tsai ..... H03H 7/427 333/181
2007/0285911 A1 * 12/2007 Feist ..... H01F 27/027 361/836
2008/0129436 A1 * 6/2008 Feist ..... H01F 27/027 336/208
2010/0156586 A1 * 6/2010 Hundt ..... H01F 17/062 336/196
2012/0319810 A1 * 12/2012 Tseng ..... H01F 27/027 336/65
2015/0228401 A1 * 8/2015 Ratz ..... H01F 27/324 336/92

FOREIGN PATENT DOCUMENTS

JP 04-162509 A 6/1992
JP H04162509 A * 6/1992 ..... H01F 27/28
JP 2507763 Y2 * 8/1996 ..... H01F 27/29
JP 2000-286136 A 10/2000
JP 2000286136 A * 10/2000 ..... H01F 37/00
JP 2009-005510 A 1/2009

OTHER PUBLICATIONS

JPH04162509A, Machine Translation, Jun. 1992.*
Japanese Office Action issued in corresponding Japanese Patent Application No. 2015-071160 dated Nov. 20, 2018.

* cited by examiner

CHOKE COIL FOR BRAKE CONTROL DEVICE

BACKGROUND OF THE INVENTION

1. Field of the Invention

The present invention relates to a choke coil for a brake control device.

2. Description of the Related Art

A choke coil for reducing noises is housed in a housing of an electronic control unit of a vehicle brake hydraulic pressure control device.

The choke coil includes a magnetic core, a case housing the core, and a lead wire wound around a core part of the case.

Some of such choke coils are formed by holding an end portion of the lead wire with a holding portion formed in an upper end portion of the core part and then resin-molding abase part such that the holding portion and the end portion of the lead wire are inserted in the base part (for example, see Japanese Patent Application Publication No. Hei 04-162509).

The conventional choke coil described above has a problem that attachment of the lead wire to the core part includes a step of molding the base part and this increases the manufacturing cost.

Moreover, the conventional choke coil described above has a problem that, since the size of the base part is large, the size of the choke coil is large in the height direction.

SUMMARY OF THE INVENTION

An object of the present invention is to solve the above-described problems, and to provide a choke coil for a brake control device, which is capable of simplifying the manufacturing steps and achieving size reduction.

In order to solve the problems described above, the present invention provides a choke coil for a brake control device, comprising: a lead wire; a magnetic core; and a case housing the core. The case includes: a cylindrical core part around which the lead wire is wound; and a base part provided on an outer peripheral surface of the core part. An end portion of the lead wire extends laterally from the core part, and a holding portion configured to hold the end portion of the lead wire is formed on an outer surface of the base part on the opposite side to the core part side.

In the present invention, since the end portion of the lead wire can be stably held in the base part without resin-molding the base part after attachment of the end portion of the lead wire to the holding portion, assembly steps of the choke coil can be simplified.

Moreover, in the present invention, since the dimensional accuracy of the end portion of the lead wire can be improved, the attachment accuracy of the choke coil can be improved.

Furthermore, in the present invention, the size of the base part can be reduced. In addition, since the end portion of the lead wire is in contact with the outer surface of the base part, the size of the choke coil can be reduced in the height direction.

Accordingly, in the present invention, it is possible to reduce a space for attaching the choke coil and therefore reduce the size of a housing.

In the aforementioned choke coil for a brake control device, when the holding portion has a pair of claw portions configured to hold the end portion of the lead wire therebetween, the end portion of the lead wire can be positioned in the base part in a simple structure.

In the aforementioned choke coil for a brake control device, when one end portion of the lead wire extends laterally toward one side from the core part, and another end portion of the lead wire extends laterally toward another side from the core part, it is desirable that the holding portion is formed in each of end portions of the base part on the one side and the other side thereof, and both end portions of the lead wire are held respectively by the holding portions.

In this configuration, since both end portions of the lead wire are held on the one side and the other side of the base part, both end portions of the lead wire can be more stably held.

In the aforementioned choke coil for a brake control device, when a protruding portion protruding in a direction intersecting an extending direction of the end portion of the lead wire is formed in the base part and the holding portion is formed in the protruding portion, the lead wire can be bent to extend along the protruding portion. Accordingly, attachability of the lead wire can be improved.

Moreover, in the configuration described above, since the lead wire can be bent while being brought into contact with the protruding portion, the height of the end portion of the lead wire in the housing can be reduced compared to that in the conventional choke coil. This can reduce the height of a connection terminal to which the end portion of the lead wire is connected, and thereby reduce the manufacturing cost of the housing.

In the aforementioned choke coil for a brake control device, when the core part and the base part are formed integrally and the number of parts is reduced, the manufacturing cost can be reduced.

The choke coil for a brake control device of the present invention can simplify the manufacturing steps and reduce the manufacturing cost. Moreover, the present invention can reduce the size of the choke coil for a brake control device in the height direction.

BRIEF DESCRIPTION OF THE DRAWINGS

FIG. 3A is a side view, FIG. 3B is a front view, and FIG. 3C is a back view.

FIG. 4A is a plan view, and FIG. 4B is a perspective view from below.

DETAILED DESCRIPTION OF THE EMBODIMENTS

An embodiment of the present invention will be described in detail with reference to the drawings as appropriate.

In the embodiment, description is given of an example in which a choke coil of the present invention is applied to an electronic control unit of a vehicle brake hydraulic pressure control device.

Note that directions of up, down, front, rear, left, and right in the embodiment are set for the sake of convenience to facilitate description of the choke coil, the electronic control unit, and the vehicle brake hydraulic pressure control device, and do not limit the structures of the devices.

Figure 2:
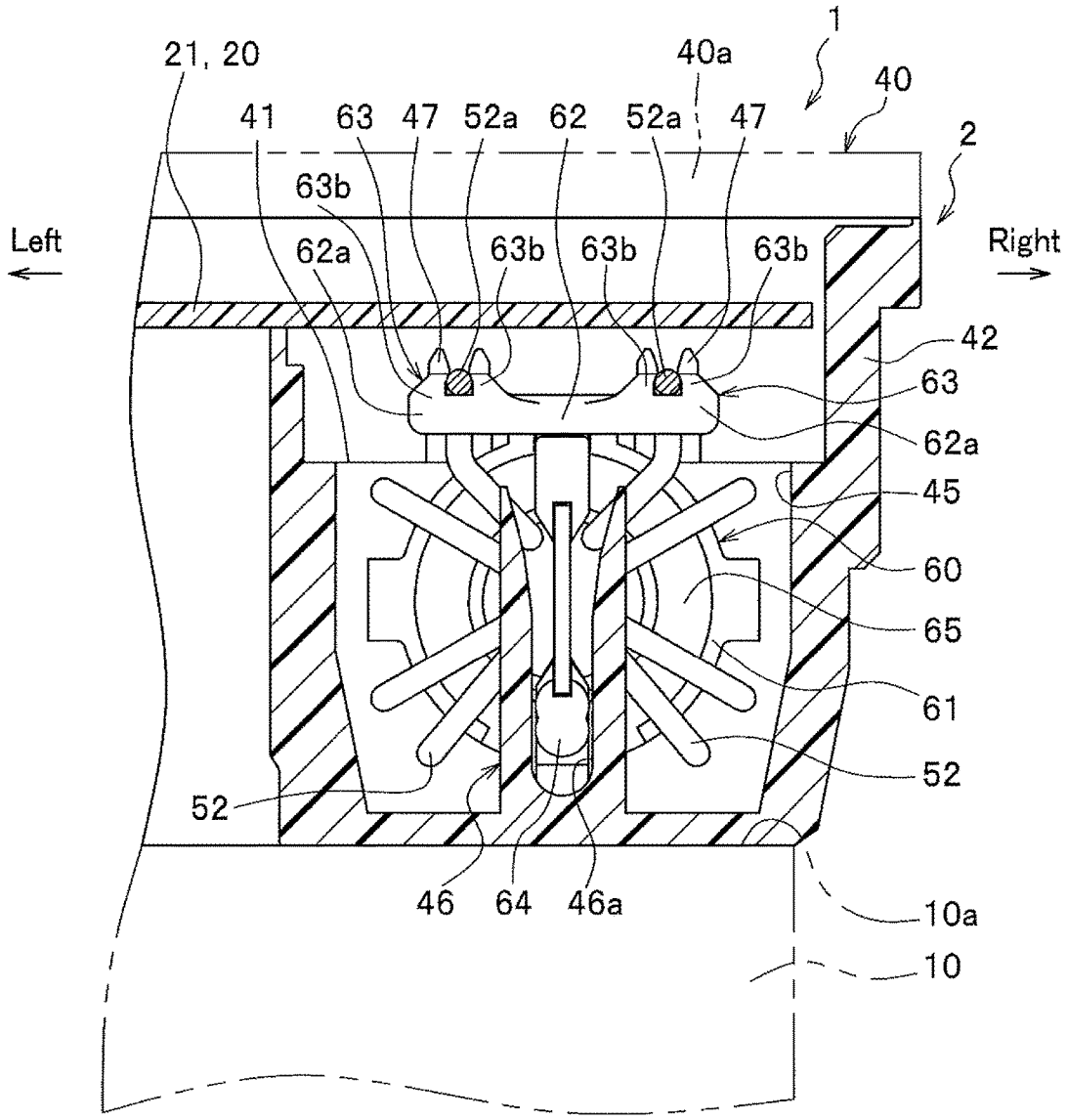
FIG. 2 is a cross-sectional view illustrating a choke coil in the embodiment of the present invention along the line A-A in FIG. 1.

A vehicle brake hydraulic pressure control device 1 illustrated in FIG. 2 generates a brake hydraulic pressure by driving a motor according to an operation amount of a brake pedal.

The vehicle brake hydraulic pressure control device 1 can be mounted not only in a vehicle which uses an engine (internal combustion engine) alone as a power source but also in a hybrid vehicle which uses both of an engine and a motor, an electric vehicle and a fuel cell vehicle which use a motor alone as a power source, and the like.

The vehicle brake hydraulic pressure control device 1 includes a base body 10 in which a brake fluid channel is formed and an electronic control unit 2 which is attached to one surface 10*a* of the base body 10.

The base body 10 is a metal part mounted in the vehicle and the brake fluid channel is formed inside the base body 10. Moreover, various parts such as a solenoid valve and a motor are attached to the base body 10.

The electronic control unit 2 includes an electronic board 20 which controls the solenoid valve, the motor, and the like, a choke coil 50 which reduces noises generated in an electronic circuit of the electronic board 20, and a housing 40 in which the electronic board 20 and the choke coil 50 are housed.

Figure 1:
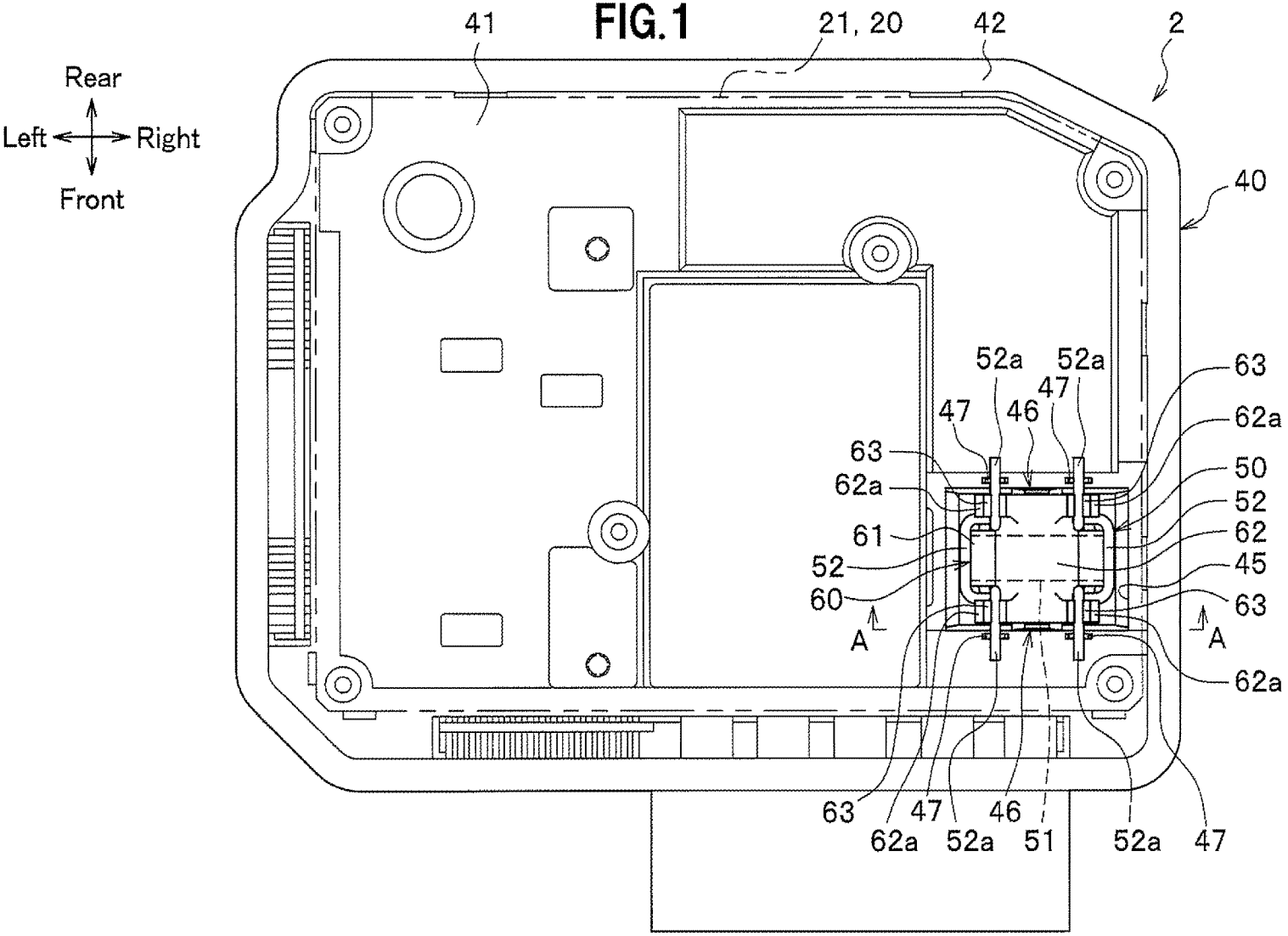
FIG. 1 is a plan view illustrating a choke coil and a housing in an embodiment of the present invention.

The housing 40 is a box body which is made of a synthetic resin and which is attached to the one surface 10*a* of the base body 10 to cover electrical parts such as the solenoid valve and a pressure sensor protruding from the one surface 10*a* of the base body 10. The housing 40 is formed such that the outer peripheral shape thereof is a substantially-rectangular shape as illustrated in FIG. 1.

As illustrated in FIG. 2, the housing 40 includes a plate-shaped partition part 41 and a peripheral wall part 42 formed in a peripheral edge portion of the partition part 41. The partition part 41 is formed substantially at the center of the peripheral wall part 42 in a height direction.

The housing 40 is open on an upper surface (front surface) and a lower surface (back surface). An upper opening portion of the housing 40 is sealed by a cover 40*a* made of a synthetic resin.

The electronic board 20 is a board obtained by attaching electronic parts such as a semiconductor chip to a rectangular board main body 21 on which an electronic circuit is printed.

The electronic board 20 is configured to control operations of the solenoid valve and the motor based on information obtained from various sensors such as the pressure sensor, a program stored in advance, and the like.

The board main body 21 is attached to multiple supporting portions provided on a surface of the partition part 41 to protrude therefrom and is arranged to be spaced away from the upper surface of the partition part 41.

The choke coil 50 is housed in the housing 40 and is attached on the upper surface side of the partition part 41.

The choke coil 50 in the embodiment is a common mode choke coil configured to reduce common mode noises generated between the ground (GND) and a signal line and between the ground (GND) and a power supply line in the electronic circuit of the electronic board 20.

Figure 3A:
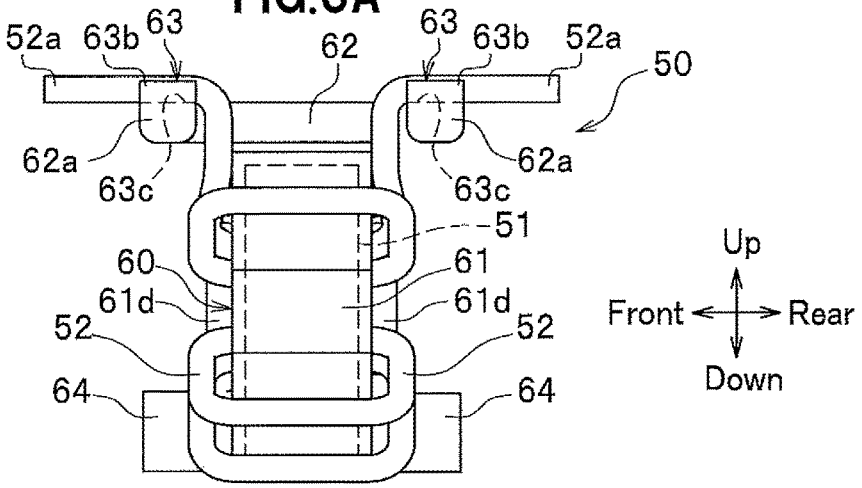
FIGS. 3A to 3C are views illustrating the choke coil in the embodiment of the present invention.
Figure 3B:
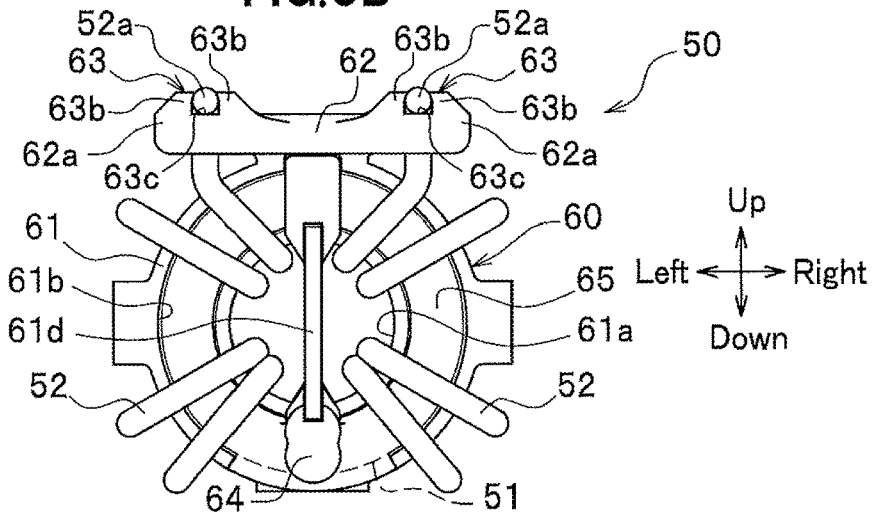
Figure 3C:
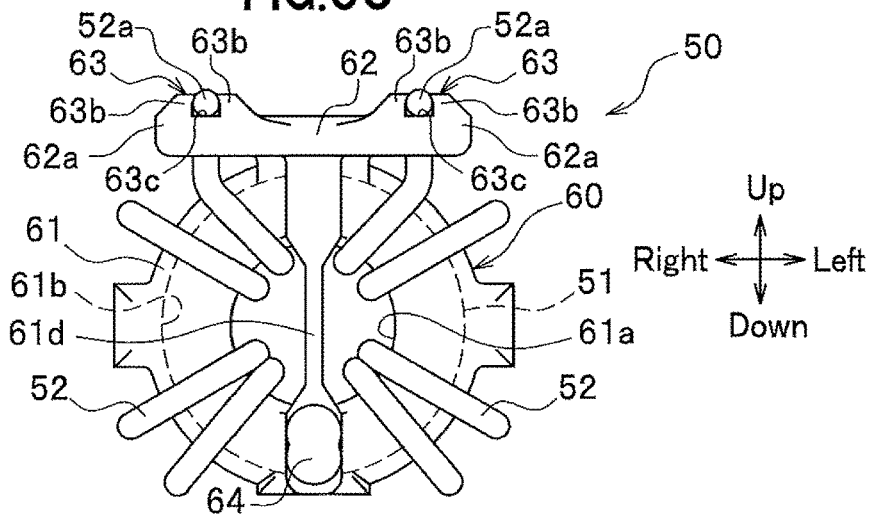

As illustrated in FIG. 3C, the choke coil 50 includes two left and right lead wires 52, 52, a core 51, and a case 60 housing the core 51. The core 51 is a magnetic core for a coil which is made of iron and is formed in a cylindrical shape.

Figure 4A:
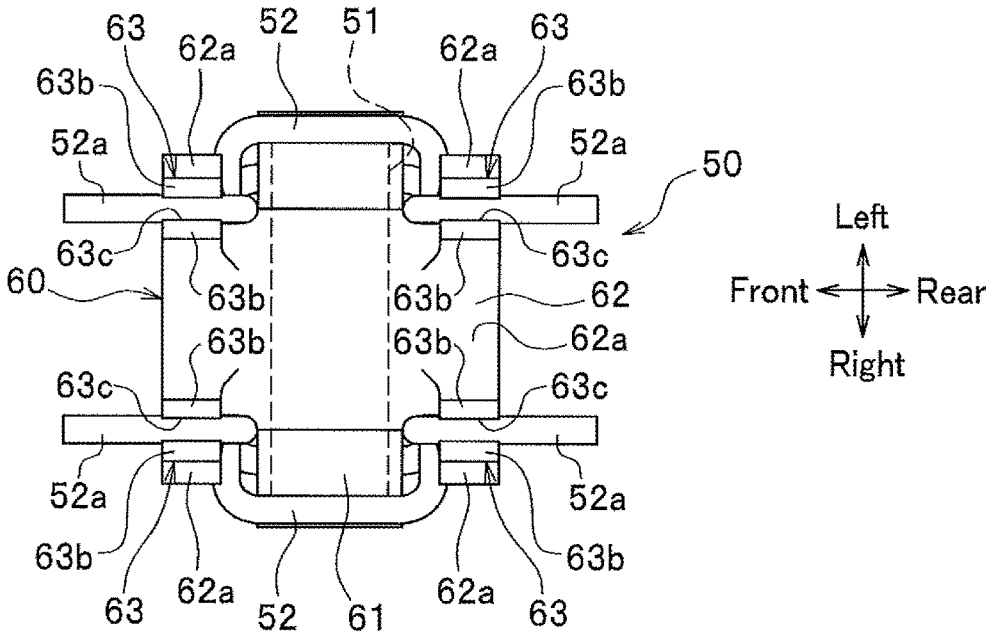
FIGS. 4A and 4B are views illustrating the choke coil in the embodiment of the present invention.
Figure 4B:
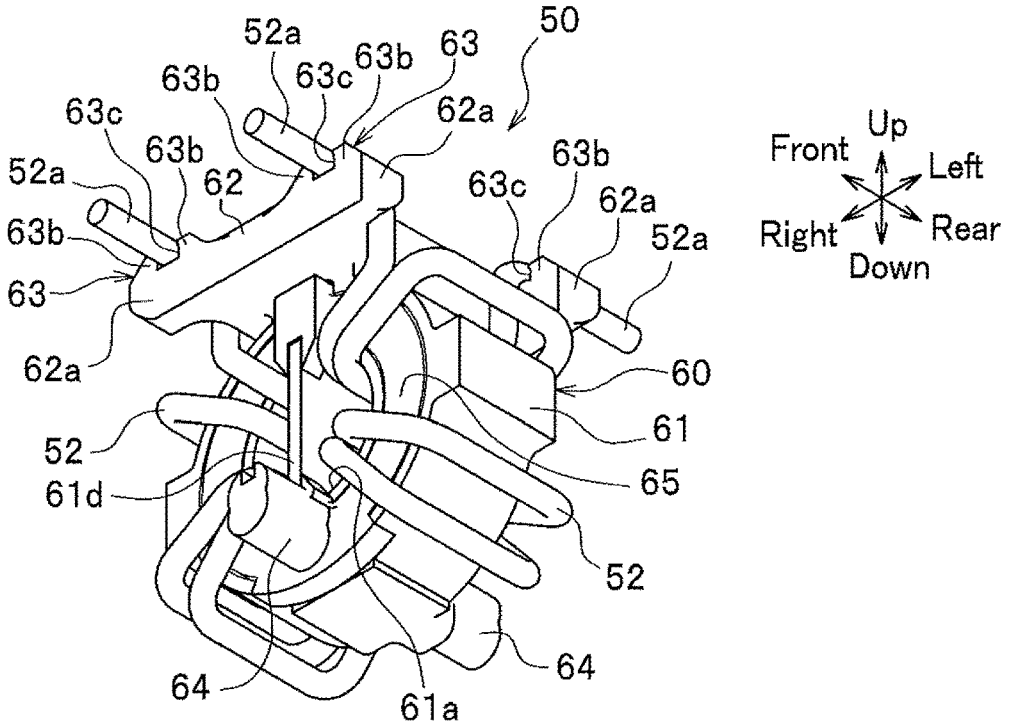

The case 60 is a member made of a synthetic resin and, as illustrated in FIG. 4B, has a cylindrical core part 61, a base part 62 provided on an upper end portion of an outer peripheral surface of the core part 61, and two front and rear holding portions 63, 63 formed in the base part 62. The case 60 also has a lid plate 65 and a partition wall 61*d* which are attached to the core part 61 and two front and rear engagement portions 64, 64 which are formed on lower end portions of the core part 61 and the lid plate 65.

As illustrated in FIG. 3B, a center hole 61*a* penetrates the core part 61 in a front-rear direction. The center axis direction of the core part 61 is aligned in the front-rear direction.

As illustrated in FIG. 3C, a cylindrical housing space 61*b* is formed in the core part 61. The core 51 is housed in the housing space 61*b*. As illustrated in FIG. 3B, a front surface of the housing space 61*b* is open.

The lid plate 65 is a cylindrical member attached to a front surface of the core part 61. An opening portion of the housing space 61*b* is closed by the lid plate 65.

The partition wall 61*d* is attached inside the center hole 61*a* of the core part 61. The partition wall 61*d* partitions a space in the center hole 61*a* into left and right sections.

As illustrated in FIG. 4B, one of the pair of engagement portions 64, 64 is provided to protrude forward from a lower end portion of a front surface of the lid plate 65. Meanwhile, as illustrated in FIG. 3C, the other engagement portion 64 is provided to protrude rearward from a lower end portion of a rear surface of the core part 61. As illustrated in FIG. 2, both engagement portions 64, 64 are portions which engage with supporting portions 46 in a housing part 45 of the housing 40.

As illustrated in FIG. 4A, the plate-shaped base part 62 is formed on the upper end portion of the outer peripheral surface of the core part 61. A front end portion and a rear end portion of the base part 62 protrude in the front-rear direction beyond the front surface and the rear surface of the core part 61.

Protruding portions 62*a* protruding leftward and rightward are formed in the front end portion and the rear end portion of the base part 62. Specifically, four protruding portions 62*a* are formed in front-left, front-right, rear-left, and rear-right corners of the base part 62. Each pair of left and right protruding portions 62*a*, 62*a* are within the maximum width of the core part 61 in a left-right direction.

Holding portions 63 are formed respectively in upper surfaces of the protruding portions 62*a* (outer surfaces of the protruding portions 62*a* on an opposite side to the core part 61 side). The holding portions 63 are portions configured to hold end portions 52*a* of the lead wires 52.

Each holding portion 63 has a pair of claw portions 63*b*, 63*b* holding the end portion 52*a* of the lead wire 52 therebetween. The pair of claw portions 63*b*, 63*b* are formed in shapes extending linearly from a front edge portion to a rear edge portion of the upper surface of the protruding portion 62*a*.

The pair of claw portions 63*b*, 63*b* are arranged to be spaced away from each other in the left-right direction. As illustrated in FIG. 3B, a recess groove 63*c* is formed between the pair of claw portions 63*b*, 63*b*. The recess groove 63*c* is formed to have substantially the same width as the outer diameter of the lead wire 52.

Upper end portions of the pair of claw portions 63*b*, 63*b* protrude toward an inside of the recess groove 63*c*. Accordingly, the pair of claw portions 63*b*, 63*b* are formed such that a gap between the upper end portions thereof is smaller than a gap between lower portions thereof. In other words, the recess groove 63*c* is formed such that the width in an upper end portion is smaller than the width in a lower portion.

Moreover, the height of each claw portion 63*b* is set such that the end portion 52*a* of the lead wire 52 is fitted below the upper end portions of the pair of claw portions 63*b*, 63*b*.

As illustrated in FIG. 3A, the right lead wire 52 is wound around the right half of the core part 61 (see FIG. 3B).

The right lead wire 52 is lead wire out from an upper portion of the core part 61 on the front surface side and the rear surface side thereof and extends upward through a space between the pair of front and rear protruding portions 62*a*, 62*a*.

Moreover, a front portion of the right lead wire 52 is bent forward at a right angle to extend along a rear surface and the upper surface of the front-right protruding portion 62*a*. The front end portion 52*a* of the lead wire 52 thereby extends forward (laterally) from the core part 61.

As illustrated in FIG. 3B, the end portion 52*a* of the lead wire 52 is fitted into the recess groove 63*c* between the pair of claw portions 63*b*, 63*b*. The end portion 52*a* of the lead wire 52 is thus held by and between the pair of claw portions 63*b*, 63*b* to be held by the holding portion 63.

Moreover, as illustrated in FIG. 3A, the front end portion 52*a* of the lead wire 52 is protruding forward from the front holding portion 63.

Note that, as illustrated in FIG. 3B, the gap between the upper end portions of the pair of claw portions 63*b*, 63*b* is smaller than the outer diameter of the end portion 52*a* of the lead wire 52. Moreover, since the end portion 52*a* of the lead wire 52 is fitted below the upper end portions of the pair of claw portions 63*b*, 63*b*, the end portion 52*a* of the lead wire 52 is surely held by the holding portion 63.

As illustrated in FIG. 3A, a rear end portion 52*a* of the right lead wire 52 is bent rearward at a right angle to extend along a front surface and the upper surface of the rear-right protruding portion 62*a*. The rear end portion 52*a* of the lead wire 52 thereby extends rearward (laterally) from the core part 61.

Moreover, as illustrated in FIG. 4A, the rear end portion 52*a* of the lead wire 52 is held by the rear-right holding portion 63 in a way similar to the front end portion 52*a*.

As illustrated in FIG. 3B, the left lead wire 52 is wound around the left half of the core part 61 as in the right half. The left lead wire 52 is lead wire out from the upper portion of the core part 61 on the front surface side and the rear surface side thereof, and extends upward through the space between the front and rear protruding portions 62*a*, 62*a* (see FIG. 4A).

Since the space in the center hole 61*a* of the core part 61 is partitioned into left and right sections by the partition wall 61*d*, the left and right lead wires 52, 52 are prevented from coming into contact with each other.

As illustrated in FIG. 4A, both end portions 52*a*, 52*a* of the left lead wire 52 are held by the front-left and rear-left holding portions 63, 63 in a similar way to both end portions 52*a*, 52*a* of the right lead wire 52.

Next, description is given of an attachment structure of the choke coil 50 in the housing 40.

As illustrated in FIG. 1, the housing part 45 in which the core part 61 of the choke coil 50 is housed is formed on the upper surface of the partition part 41 of the housing 40.

The housing part 45 is a bottomed recess portion formed on the upper surface of the partition part 41 (see FIG. 2). The pair of supporting portions 46, 46 are provided on front and rear side surfaces of the housing part 45 out of side surfaces of the housing part 45 to protrude therefrom, the front and rear side surfaces facing front and rear end surfaces of the core part 61.

As illustrated in FIG. 2, in the supporting portions 46, there are formed supporting grooves 46*a* in which the engagement portions 64 of the core part 61 are inserted. The supporting grooves 46*a* are recess grooves linearly extending upward from a bottom surface of the housing part 45. The supporting grooves 46*a* are open on inner surfaces and upper end surfaces of the supporting portions 46.

The engagement portions 64 of the core part 61 are press fitted into the supporting grooves 46*a* from above and are thereby held by the supporting portion 46.

As illustrated in FIG. 1, four connection terminals 47 are provided on the upper surface of the partition part 41 of the housing 40 to protrude therefrom.

Two left and right connection terminals 47 are provided on each of the front side and the rear side of an opening portion of the housing part 45.

The connection terminals 47 are formed in distal end portions of bus bars (not illustrated) embedded in the partition part 41. Base end portions of the bus bars are electrically connected to the electronic circuit of the electronic board 20.

As illustrated in FIG. 2, the end portions 52*a*, 52*a* of both lead wires 52, 52 of the choke coil 50 are inserted respectively into groove portions provided in distal end portions of the connection terminals 47. Then, the connection terminals 47 are held by and between electrodes of a welding device from left and right sides and electricity is supplied to the electrodes in this state to weld the end portions 52*a*, 52*a* of the lead wires 52, 52 to the connection terminals 47 by electrical resistance welding.

The choke coil 50 and the electronic circuit of the electronic board 20 are thus electrically connected to each other via the bus bars (not illustrated).

In the state where the both lead wires 52, 52 of the choke coil 50 are attached to the connection terminals 47, the core part 61 is inserted in the housing part 45. Moreover, the engagement portions 64 of the core part 61 are held by the supporting portions 46.

In the choke coil 50 of the embodiment, as illustrated in FIG. 3A, attachment of each of the lead wires 52 to the core part 61 is performed such that the lead wire 52 is wound around the core part 61 and then lead wire out from the upper portion of the core part 61 on the front surface side and the rear surface side thereof. Then, the lead wire 52 is lead wire out to extend above the base part 62 through the space between the pair of front and rear protruding portions 62*a*, 62*a*.

Next, the lead wire 52 is bent at a right angle to extend along the outer surfaces of the protruding portions 62*a* and each of the end portions 52*a* of the lead wire 52 is made to extend forward or rearward. In this case, the lead wire 52 is bent while being brought into contact with the outer surfaces of the protruding portions 62*a*.

Furthermore, as illustrated in FIG. 3B, each of the end portions 52*a* of the lead wires 52 is pushed into the gap between the pair of claw portions 63*b*, 63*b* of the holding portion 63 to be held by and between the pair of claw portions 63*b*, 63*b*.

The end portions 52*a* of the left and right lead wires 52, 52 are thereby held respectively by the holding portions 63 as illustrated in FIG. 4A, and the attachment of the lead wires 52 to the case 60 is completed.

In the choke coil 50 described above, the holding portions 63 which are each formed of the pair of claw portions 63*b*, 63*b* and which have simple structures can position the end portions 52*a* of the lead wires 52 in the base part 62 and stably hold the end portions 52*a* of the lead wires 52. Accordingly, assembly steps of the choke coil 50 can be simplified.

Moreover, in the choke coil 50 in the embodiment, as illustrated in FIG. 1, since the dimensional accuracy of the end portions 52*a* of the lead wires 52 can be improved, the attachment accuracy of the choke coil 50 can be improved.

Furthermore, in the choke coil 50 in the embodiment, as illustrated in FIG. 3A, since the lead wires 52 can be bent outside the protruding portions 62*a* to extend along the outer surfaces of the protruding portions 62*a*, the attachability of the lead wires 52 can be improved compared to the configuration in which the lead wires 52 are inserted into hole portions formed in the base part 62.

Moreover, in the choke coil 50 in the embodiment, since both end portions 52*a*, 52*a* of each lead wire 52 are held by the holding portions 63, 63 formed in the front and rear end portions of the base part 62, both end portions 52*a*, 52*a* of the lead wire 52 can be more stably held.

Furthermore, in the choke coil 50 in the embodiment, as illustrated in FIG. 3B, since the end portions 52*a* of the lead wires 52 can be stably held in the base part 62 without resin-molding the base part 62 after the attachment of the end portions 52*a* of the lead wires 52 to the holding portions 63, the size of the base part 62 can be reduced.

Moreover, in the choke coil 50 in the embodiment, as illustrated in FIG. 3A, the lead wires 52 can be bent to be brought into tight contact with the outer surfaces of the protruding portions 62*a*. In addition, since the end portions 52*a* of the lead wires 52 are in contact with the upper surface of the base part 62, the size of the choke coil 50 can be reduced in the height direction.

Since the size of the choke coil 50 can be reduced as described above, it is possible to reduce a space for attaching the choke coil 50 and therefore reduce the size of the housing 40 as illustrated in FIG. 1.

Moreover, as illustrated in FIG. 2, since the gap between the upper surface of the partition part 41 of the housing 40 and each of the end portions 52*a* of the lead wires 52 can be reduced, the height of the end portions 52*a* of the lead wires 52 in the housing 40 can be reduced compared to that in the conventional choke coil. Since this can reduce the height of the connection terminals 47, the manufacturing cost can be reduced.

Furthermore, in the choke coil 50 in the embodiment, as illustrated in FIG. 3B, since the core part 61 and the base part 62 are formed integrally, it is possible to reduce the number of parts and reduce the manufacturing cost.

Although the embodiment of the present invention has been described above, the present invention is not limited to the embodiment described above and can be changed as appropriate within a scope not departing from the spirit of the present invention.

In the embodiment, as illustrated in FIG. 4A, the end portions 52*a* of the two lead wires 52, 52 are held by the four holding portions 63. However, not all of the end portions 52*a* of the lead wires 52 need to be held by the holding portions 63. It is only necessary that at least one holding portion 63 is formed in the base part 62.

Although the two lead wires 52, 52 are wound around the core part 61 in the embodiment as illustrated in FIG. 3B, the number of the lead wires 52 is not limited to two. Moreover, the shape of the core part 61 is not limited to that in the embodiment.

Although the core part 61 and the base part 62 are formed integrally in the embodiment, the configuration may be such that the core part 61 and the base part 62 are formed separately and the base part 62 is bonded to the core part 61.

Although each of the end portions 52*a* of the lead wires 52 is held by the pair of claw portions 63*b*, 63*b* in the embodiment, the configuration of the holding portion 63 is not limited to this. For example, the configuration may be such that a hook-shaped protruding portion is formed on the upper surface of the holding portion 63 and the end portion 52*a* of the lead wire 52 is hooked to this protruding portion.

Although the choke coil 50 in the embodiment is a common mode choke coil, the present invention can be applied to a normal mode choke coil configured to reduce normal mode noises generated between signal lines and between power supply lines in an electronic circuit of an electronic board.

1: vehicle brake hydraulic pressure control device; 2: electronic control unit; 10: base body; 20: electronic board; 21: board main body 21; 40: housing; 41: partition part; 45: housing part; 46: supporting portion; 46*a*: supporting groove; 47: connection terminal; 50: choke coil; 51: core; 52: lead wire; 52*a*: end portion; 60: case; 61: core part; 61*a*: center hole; 61*b*: housing space; 61*d*: partition wall; 62: base part; 62*a*: protruding portion; 63: holding portion; 63*b*: claw portion; 63*c*: recess groove; 64: engagement portion; 65: lid plate.

What is claimed is:

1. A choke coil for a brake control device, comprising:

a lead wire;

a magnetic core; and a case housing the core, wherein the case includes:

a cylindrical core part around which the lead wire is wound; and a base part provided on an outer peripheral surface of the core part, an end portion of the lead wire extends laterally from the core part, and a holding portion configured to hold the end portion of the lead wire is formed on an outer surface of the base part on the opposite side to the core part side, wherein the holding portion has a pair of claw portions configured to hold the end portion of the lead wire therebetween, wherein the pair of claw portions includes a recess groove with a solid flat bottom into which the end portion of the lead wire is disposed, wherein the recess groove extends laterally from the core part and in the same direction as the end portion of the lead wire, wherein the cylindrical core part and the base part constitute one single integral continuous unit, wherein a protruding portion protruding in a direction intersecting an extending direction of the end portion of the lead wire is formed in the base part and the holding portion is formed in the protruding portion, and wherein the lead wire is bent to extend along the protruding portion.

2. The choke coil for a brake control device according to claim 1, wherein one end portion of the lead wire extends laterally toward one side from the core part, another end portion of the lead wire extends laterally toward another side from the core part, the holding portion is formed in the base part on the one side and the other side thereof, and both end portions of the lead wire are held respectively by the holding portions.

* * * * *